US007335238B2

(12) United States Patent
Elliott

(10) Patent No.: US 7,335,238 B2
(45) Date of Patent: Feb. 26, 2008

(54) METHOD FOR PRODUCING FERROUS PICRATE

(75) Inventor: Alan F. Elliott, South Melbourne (AU)

(73) Assignee: RDI Construction, South Point, OH (US)

( * ) Notice: Subject to any disclaimer, the term of this patent is extended or adjusted under 35 U.S.C. 154(b) by 643 days.

(21) Appl. No.: 10/900,601

(22) Filed: Jul. 27, 2004

(65) Prior Publication Data

US 2005/0055872 A1 Mar. 17, 2005

(30) Foreign Application Priority Data

Sep. 11, 2003 (AU) ..... 2003904964

(51) Int. Cl.
*C10L 1/18* (2006.01)
*C10L 1/22* (2006.01)
*C07F 15/02* (2006.01)

(52) U.S. Cl. ..... 44/323; 44/413; 556/146; 556/150

(58) Field of Classification Search ..... 44/323, 44/413; 556/146, 150
See application file for complete search history.

(56) References Cited

U.S. PATENT DOCUMENTS

| | | | | |
|---|---|---|---|---|
| 2,506,539 | A | 5/1950 | Boardman | |
| 3,282,858 | A | 11/1966 | Simmons | |
| 4,073,626 | A | 2/1978 | Simmons | |
| 4,099,930 | A | 7/1978 | Webb | |
| 4,129,421 | A | 12/1978 | Webb | |
| 4,265,639 | A | 5/1981 | Scholtz | |
| 4,397,654 | A | 8/1983 | 'T Hart | |
| 4,424,063 | A | 1/1984 | Hart | |
| 5,087,268 | A | 2/1992 | Parish | |
| 5,359,103 | A | 10/1994 | Elliott | |
| 5,562,742 | A | 10/1996 | Kolp et al. | |
| 5,720,783 | A | 2/1998 | Elliott | |
| 5,925,153 | A | 7/1999 | Riegel | |
| 6,670,495 | B2 * | 12/2003 | Stewart | 556/150 |
| 6,833,466 | B2 * | 12/2004 | Elliott et al. | 556/150 |
| 6,969,773 | B2 * | 11/2005 | Stewart | 556/150 |
| 2003/0213166 | A1 | 11/2003 | Stewart | |

FOREIGN PATENT DOCUMENTS

| | | |
|---|---|---|
| AU | B-63110/90 | 6/1991 |
| AU | B-57904/90 | 9/1991 |
| DE | 27 59 055 A1 | 12/1979 |
| WO | WO 94/26689 | 11/1994 |

* cited by examiner

*Primary Examiner*—Cephia D. Toomer
(74) *Attorney, Agent, or Firm*—TraskBritt

(57) ABSTRACT

The present invention relates to the manufacture of ferrous picrate and the preparation of fuel additives containing ferrous picrate. A process for producing ferrous picrate includes dissolving picric acid in a mixture of an aromatic hydrocarbon and an aliphatic alcohol in the presence of a trace amount of water and a metallic iron, thus forming a ferrous picrate solution. The ferrous picrate solution is blended with an organic solvent to form the fuel additive. Ferrous picrate produced by the product is also described.

20 Claims, No Drawings

METHOD FOR PRODUCING FERROUS PICRATE

TECHNICAL FIELD

The present invention relates to the manufacture of ferrous picrate and the preparation of fuel additives containing ferrous picrate. More particularly, the present invention relates to a method of ferrous picrate production of improved efficiency and which produces fewer impurities as compared with known methods.

BACKGROUND

The cost of diesel fuel is a major contributor to the operating cost of mining or manufacturing sites that operate diesel driven equipment. Ideally, diesel engines would operate at 100% efficiency with the fuel burning completely and instantaneously when the piston is at the top of the power stroke. At this point, the cylinder volume is at its minimum and a maximum amount of energy (as heat) would be extracted from the fuel and used to power the engine. However, in reality, no fuel combustion is 100% efficient and even modern diesel engines have a thermal efficiency of only 35-40%. In practice, the fuel energy is made available more gradually (by slower burn), cylinder pressure rises and falls well short of the ideal.

Much energy is lost as heat from the engine exhaust. The rest of the energy is lost by radiation or is lost to the cooling system as it removes excess heat from the engine.

It seems unlikely that further on-going engine design improvements can offer any major improvements to thermal efficiency. Although there has been an increase in engine performance, the performance characteristics of modern diesel fuel have remained relatively stable over recent years.

However, improvements in fuel technology still offer potential area savings and for the past 2 decades, attempts have been made to chemically improve fuels. For example, attempts have been made to chemically improve the overall combustion reaction by the addition of trace amounts of a ferrous picrate catalyst.

Over the past two decades of commercial use by the mining industry in Australia, for instance, ferrous picrate use has resulted in fuel savings of 6-8% for mine mobile equipment and 3-5% for large medium speed engines in power generation service.

An intensive study involving approximately fifty large diesel power generation sets was conducted by Fuel Technology Pty Ltd, a company specializing in combustion and fuel technology. The study showed that when using catalyst treated fuel, exhaust temperatures were reduced an average 9.2° C. under static load conditions. This result is interpreted to mean that use of the catalyst provides more useable heat from the fuel, so that less fuel is used and less heat is wasted via the exhaust.

In light of its efficacy, efforts have been made to develop more commercially attractive methods for producing ferrous picrate. For some purposes, such as addition to carbonaceous fuel, it is highly desirable that ferrous picrate be substantially free from ferric compounds and other undesirable impurities. However, it has proved difficult to produce ferrous picrate free from such impurities by a commercially acceptable method.

Furthermore, most of the processes for purification described in the patent literature involve several steps, resulting in relatively low yields and rendering the product expensive.

Another problem associated with the processes of the prior art is that they use toxic or hazardous reactants, such as ferrous picrate and picric acid which in the solid state may be explosive. Reactants of this type require special handling with due regard to appropriate safety precautions which further increases the cost of ferrous picrate manufacture.

Accordingly, efforts have been made to find commercially acceptable processes for manufacturing comparatively pure ferrous picrate. For example, U.S. Pat. No. 5,359,103 describes a process for preparing ferrous picrate comprising reacting picric acid in solution in a straight or branched chain aliphatic alcohol and an aromatic solvent with iron carbonyl at a temperature between 10 and 120° C. This process has a high yield of ferrous picrate and has relatively few steps. However, the major disadvantage is that it uses iron carbonyl which is highly toxic and requires special equipment and expertise to handle, factors that contribute significantly to the manufacturing cost and limit use of the process to specialized factories.

Another example of a process for preparation of ferrous picrate is described in Australian Patent No. 624964 (57904/90). This process includes the steps of (a) reacting an aqueous solution of a ferrous salt with an alkali hydroxide to produce a ferrous hydroxide precipitate, (b) removing water and by-products from the ferrous hydroxide, (c) adding the ferrous hydroxide and a straight or branched chain aliphatic alcohol to a solution of picric acid in an aromatic solvent from which water has been removed to produce a solution of ferrous picrate, and (d) removing any insoluble material from the solution, wherein the steps are performed under an inert atmosphere.

Another method for producing ferrous picrate comprises reacting, under non-oxidizing conditions, ferrous carbonate free from ferric compounds with a water-free solution of picric acid in a solvent medium selected from an aromatic hydrocarbon solvent, a mixture of aromatic hydrocarbon solvents, a straight-or a branched-chain aliphatic alcohol, a mixture of straight-and/or branched-chain aliphatic alcohols, and a mixture of straight-and/or branched-chain aliphatic alcohols with aromatic hydrocarbon solvents to produce a solution of ferrous picrate.

Producers of industrial chemicals, such as ferrous picrate, continually attempt to improve their processes and obtain commercial savings in terms of production costs and the input of time and energy to their processes. Some commercial savings can be derived from minimizing the use or handling of hazardous materials, reducing energy input to the process and producing products of good purity so that the need for further the purification is minimized or eliminated.

Thus, an ongoing need exists for improvements to ferrous picrate production processes in terms of commercial efficiency, product purity and product storage stability. In particular, a need exists for a process for producing ferrous picrate that is comparatively simple and commercially viable, yet produces comparatively few ferric compounds and other impurities by comparison with the ferrous picrate production methods of the prior art. A need also exists for the ferrous picrate product to exhibit storage stability when incorporated into carbonaceous fuels.

SUMMARY OF THE INVENTION

Disclosed, in one embodiment, is a process for producing a ferrous picrate that includes dissolving picric acid in a mixture of an aromatic hydrocarbon and an aliphatic alcohol in the presence of a trace amount of water and a metallic iron to form a ferrous picrate solution, and blending the ferrous picrate solution with an organic solvent to form the ferrous picrate having a water content not exceeding about 0.25% by volume.

In another embodiment, a process for producing a ferrous picrate additive for fuels, the process comprising reacting metallic iron, picric acid, and water together in a solvent comprising a mixture of one or more aliphatic alcohols and another component selected from aromatic hydrocarbons, paraffins and naphthenes or mixtures thereof, thus forming a ferrous picrate solution, and blending the ferrous picrate solution with an organic solvent to form a fuel additive or a fuel additive concentrate, wherein the fuel additive or the fuel additive concentrate has a water content not exceeding about 0.25% by volume. A product produced by this product is also described.

The reactions may be carried out at a temperature in the range of from about 5 to about 60° C., including ambient temperature. One of the advantages of the process of the present invention is that the reaction between metallic iron and picric acid may occur at room temperature so that it is unnecessary to add energy in the form of heat. This feature provides savings in installation and running costs over the ferrous picrate processes of the prior art, such as the carbonyl process.

The reaction may be carried out under an inert atmosphere using an inert gas that inhibits undesirable oxidation reactions and avoids fire risk. Any inert gas such as nitrogen or argon would provide such a suitable inert atmosphere.

As used herein, the proportion of water in the reaction is expressed as the % volume of water in the total volume of liquid.

The trace amount of water may catalyze the reaction between picric acid dissolved in the solvent and metallic iron. The trace amount of water used to dissolve the picric acid in the mixture of the aromatic hydrocarbon and the aliphatic alcohol may be between about 0.25 and 0.5% vol.

It is undesirable that the amount of water in produced ferrous picrate exceed about 0.25% volume because the produced ferrous picrate may exhibit storage instability. Thus, the proportion of water present in the produced ferrous picrate may be between about 0.01 and 0.12% volume.

The picric acid used in the process of the present invention may be in the form of a slurry of picric acid in water. Although dry picric acid is commercially available, it is explosive and requires specialized handling techniques. One of the advantages of the instantly described processes is that the aqueous slurry of picric acid may be used instead of dry picric acid, minimizing the need for specialized handling.

If an aqueous slurry of picric acid is used, the processes disclosed herein may include an initial step of extracting the picric acid into an aromatic hydrocarbon phase and separating the hydrocarbon phase from the aqueous phase. The separation may be carried out by any convenient method such as decantation, or by use of a separation funnel.

The metallic iron may be in any convenient form such as iron filings, mild steel sheet and/or steel wool. In one embodiment, steel wool provides an inexpensive source of metallic iron and provides a large surface area to speed up the reaction with the picric acid.

Suitable aromatic hydrocarbons that may be used in the process of the present invention may be chosen from the group comprising alkyl benzenes or benzene. In one embodiment, the aromatic hydrocarbon solvent is an alkyl benzene, such as toluene, xylene or solvents marketed under the trade marked name SOLVESSO (owned by Exxon Corporation) or equivalent products which include a mixture of commercial aromatic hydrocarbon fractions. The aromatic hydrocarbon solvent may additionally include other hydrocarbon species such as paraffins and naphthenes, or both.

Suitable aliphatic alcohols may be chosen from the group including straight- or branched-chain aliphatic alcohols or mixtures thereof. Typically, the straight or branched chain aliphatic alcohols are from about $C_2$-$C_{13}$ in length. In one embodiment, the alcohol is chosen from the group consisting of iso-propanol, n-butanol, iso-octanol, tri-decanol and mixtures thereof.

The process of the present invention may further include the removal of any steel wool provided to the process as a source of metallic iron, and the removal of any other insoluble matter. For example, steel wool includes traces of silicon, carbon and metals other than iron. These traces of silicon, carbon and metals other than iron may be present as a fine black precipitate in the reaction which may be removed by filtration, decantation or other convenient method. A product produced by this product is also described.

The organic solvent may be chosen from the group including aromatic hydrocarbons, mixtures of aromatic paraffins and naphthenes, one or more aliphatic alcohols or mixtures thereof. For example, the solvent may be toluene, xylene or a commercial product comprising a mixture of aromatic hydrocarbons and paraffins and naphthenes, distillate or a straight- or branched-chain aliphatic alcohol or a solution of picric acid in an organic solvent or any mixture thereof.

In another embodiment, a process for producing a ferrous picrate additive for fuels comprises reacting steel wool, picric acid and water together in a solvent containing a mixture of one or more aliphatic alcohols and another component selected from aromatic hydrocarbons, paraffins and naphthenes or mixtures thereof, removing any unreacted steel wool and other insoluble matter from the ferrous picrate solution, and adding the ferrous picrate solution to a component selected from an aromatic hydrocarbon, a solvent containing aromatic hydrocarbons, paraffins and naphthenes, a solution of picric acid in an aromatic hydrocarbon, a solvent containing aromatic hydrocarbons, paraffins and naphthenes, an aliphatic alcohol, or any mixture of the foregoing, to form a fuel additive or fuel additive concentrate, wherein the water content of the fuel additive or the fuel additive concentrate does not exceed about 0.25% by volume. A product produced by this process is also described.

BEST MODE OF THE INVENTION

The present invention will be further described with reference to the following non-limiting examples.

EXAMPLE I

Step 1. Preparation of picric acid solution. Wet picric acid including 15 g of dry picric acid and 15 g of water were added to 500 mL of an aromatic hydrocarbon solvent such as, for example, SOLVESSO 100 and the mixture stirred gently until the picric acid was in solution. The mixture was poured into a glass separating funnel and allowed to stand until the aqueous phase had settled to the bottom and the supernatant organic phase was clear. The aqueous phase was run off into another container for disposal. Approximately 0.1% by volume of water remained in the organic phase.

Step 2. Manufacture of Fuel Additive Concentrate. To a one liter glass bottle fitted with a solvent resistant screw cap, 400 ml of the above picric acid solution, 100 ml of butanol HFP, 2 ml of water and 2.5 g of steel wool were added. The temperature of the liquid was about 22° C. The atmosphere above the liquid was replaced with nitrogen by means of a rubber tube attached to a steel bottle of nitrogen, the rubber tube removed and the glass bottle capped.

The bottle and contents were placed in a horizontal position on a laboratory roller and rotated at a speed of approximately 30 revolutions per minute. Within one minute, the liquid had assumed a definite green color indicating that a reaction between steel wool and the picric acid had commenced with the formation of ferrous picrate which is green in color.

Rolling was continued for two hours when a sample of the liquid was withdrawn and the ferrous iron content was determined by the 1.10 phenanthroline procedure. The result was 1,080 mg of ferrous iron per liter.

Rolling was continued for a further 22 hours and another sample was withdrawn. The ferrous iron content of the liquid was found by chemical analysis to be 2,010 mg per liter.

Step 3. Filtration of the Concentrate. The contents of the glass bottle were filtered through a stainless steel screen on a 10 micron mesh size, thus removing the unreacted material including the excess steel wool and the unreacted non-iron components of the steel wool such as carbon, silicon and metallic carbides. As this filtration step is rapid, the nitrogen blanket was dispensed with. The yield was 490 ml.

Step 4. Blending. The liquid obtained in Step 3 was suitable for use as an additive to carbonaceous fuel. However, as the water content was in excess of that deemed to be desirable for stability in storage, it was blended with a mixture of 100 ml of butanol HFP and 100 ml of the picric acid solution from Step 1. The water content of the final product was approximately 0.25% by volume.

EXAMPLE II

A concentrate was prepared in substantial accordance with Steps 1, 2 and 3 of Example I with the exceptions that the period of reaction was 3 hours and the water was replaced with the same quantity of the aqueous phase retained from Step 1. The ferrous iron content of the resulting liquid was found to be 1,200 mg/l.

In the chemical reaction of Step 2, picric acid combined with iron extracted from the steel wool to form ferrous picrate, thus reducing the free picric acid level of the liquid. One part by weight of iron combines with approximately 9 parts by weight of picric acid.

It has been established that water content not exceeding 0.25% by volume, free picric acid level of at least 1.5% w/v and butanol content of at least 12% by volume is suitable for product stability.

A product with a ferrous iron content of 560 mg/l, suitable for use as an additive to carbonaceous fuel, and which was stable in storage was prepared in the following manner:

| | |
|---|---|
| Fuel Additive Concentrate (1,200 mg/L ferrous iron) | 234 ml |
| Picric acid solution from Step 1 | 100 ml |
| Butanol HFP | 16 ml |
| SOLVESSO 100 | 150 ml |
| Total | 500 ml. |

EXAMPLE III

Step 1. Preparation of picric acid solution. 1,000 liters of SOLVESSO 100 or equivalent aromatic solvent was pumped into a 1,000 liter capacity reactor tank fitted with an air operated motor driving twin mixing paddles.

Wet picric acid including 30 kgs dry weight was carefully added to the solvent via the manhole on tank top with the mixing paddles rotating at 205 rpm and operating at an air pressure 140 kPa.

After addition of the picric acid, the top manhole was closed and a nitrogen blanket injected into the air space above the solvent liquid.

The mixture was stirred for 2 hours and allowed to settle for approximately one hour before the water was drained from the conical bottom of the tank via a valve. The water was drained through a glass chamber to enable the partition between water and solvent to be observed.

When the water had been partitioned, a representative sample was drawn from the tank sample point and submitted to the laboratory for a titration test to determine the free picric content of the mixture which is theoretically 3% wt/v. The picric acid solution was drained and stored in a bulk container.

Step 2. Manufacture of Fuel Additive Concentrate. 750 liters of picric acid solution was pumped into a reactor tank followed by 250 liters of n-Butanol. Metallic iron in the form of steel wool was placed into a stainless steel carrier assembly and inserted into the tank via the top manhole. The carrier assembly was held in a Vee formed block with the steel wool suspended in the solvent mixture.

Water which had been drained from the tank in step 1 upon completion of picric acid solution manufacture was added to the reactor tank at the rate of (e.g., one liter of water added for each 1,000 liters of solvent), dependent upon the moisture content of the picric acid solution. Had the reaction stalled, a further 500 mls to 1 liter of water could have been added.

Following addition of all components, the manhole cover was closed and a nitrogen blanket introduced. The mixing paddles were activated at a rotation speed of 160 rpm by the air motor operating on an air pressure of 80 kPa.

After approximately one hour of stirring, drawing of samples commenced. Drawing was continued until the samples were observed to be very dark green color at which time a sample was submitted for analysis of ferrous iron content by spectrophotometry.

Once the ferrous iron level reached 1,200-1,500 mg/l, the system was shut down. The time taken to reach this concentration of ferrous iron was approximately 24 hours.

Step 3. Blending. The storage stability of the raw concentrate produced in Step 2 is low and it was imperative to blend away to a range of finished products or to lower ferrous iron level concentrate in the range 470-600 mg/l.

The volume of concentrate required for the desired blend was calculated and pumped from the reactor tank via a 10-micron filter into a blend tank. Additional picric acid solution was added together with n-butanol and SOLVESSO 150 or equivalent aromatic solvent. The volume and relative proportions of components added may be varied according to the concentration of ferrous picrate being produced.

The blended products were subjected to quality control checks to precisely confirm the ferrous iron level before being pumped into appropriate containers for storage and/or dispatch for sale.

Modifications and improvements to the invention will be readily apparent to those of ordinary skill in the art. Such modifications and improvements are intended to be within the scope of this invention.

What is claimed is:

1. A process for producing ferrous picrate, the process comprising:

dissolving picric acid in a mixture of an aromatic hydrocarbon and an aliphatic alcohol in the presence of a trace amount of water and a composition comprising a metallic iron to form a ferrous picrate solution; and blending the ferrous picrate solution with an organic solvent to form ferrous picrate having a water content not exceeding approximately 0.25% by volume.

2. The process according to claim 1, wherein the process is performed in an inert atmosphere.

3. The process according to claim 2, wherein the inert atmosphere comprises nitrogen or argon.

4. The process according to claim 1, wherein the mixture of the aromatic hydrocarbon and the aliphatic alcohol is a solvent comprising one or more aliphatic alcohols, aromatic hydrocarbon, and other components selected from the group consisting of paraffins, naphthenes, and mixtures of any thereof.

5. The process according to claim 4, wherein the aromatic hydrocarbon is an alkyl benzene.

6. The process according to claim 5, wherein the alkyl benzene is selected from the group consisting of toluene, xylene, and combinations of any thereof.

7. The process according to claim 1, wherein the aliphatic alcohol is a $C_2$-$C_{13}$ straight- or branched-chain aliphatic alcohol.

8. The process according to claim 7, wherein the aliphatic alcohol is selected from the group consisting of iso-propanol, n-butanol, iso-octanol, tri-decanol, and mixtures of any thereof.

9. The process according to claim 1, wherein the trace amount of water is present in the range of from about 0.01 to 0.12% in the total volume of liquid.

10. The process according to claim 1, wherein the composition comprising metallic iron is steel wool.

11. The process according to claim 1, wherein the process is carried out at a temperature of between about 5° C. and about 60° C.

12. A process for producing an additive for fuels, the process comprising:

producing ferrous picrate with the process according to claim 1; and blending the ferrous picrate solution with an organic solvent, thus forming a fuel additive or a fuel additive concentrate.

13. The process according to claim 12, wherein the mixture of the aromatic hydrocarbon and the aliphatic alcohol is a solvent comprising one or more aliphatic alcohols, aromatic hydrocarbon, and other components selected from the group consisting of paraffins, naphthenes, and mixtures of any thereof.

14. The process according to claim 12, wherein the process is carried out at a temperature of between about 5° C. and about 60° C.

15. The process according to claim 12, wherein the aliphatic alcohol is a $C_2$-$C_{13}$ straight- or branched-chain aliphatic alcohol.

16. The process according to claim 1, further comprising:

wherein the composition comprising metallic iron is steel wool, removing any unreacted steel wool and other insoluble matter from the ferrous picrate solution.

17. A process for producing an additive for fuels, the process comprising:

producing ferrous picrate with the process according to claim 16; and adding the ferrous picrate solution to a component selected from the group consisting of: an aromatic hydrocarbon; a solution of picric acid in an aromatic hydrocarbon; a solvent comprising aromatic hydrocarbons, paraffins and naphthenes; an aliphatic alcohol; and mixtures of any thereof, to form a fuel additive or a fuel additive concentrate.

18. The process according to claim 17, wherein the mixture of the aromatic hydrocarbon and the aliphatic alcohol is a solvent comprising one or more aliphatic alcohols, aromatic hydrocarbon, and other components selected from the group consisting of paraffins, naphthenes, and mixtures of any thereof.

19. The process according to claim 17, wherein the process is carried out at a temperature of between about 5° C. and about 60° C.

20. The process according to claim 17, wherein the aliphatic alcohol is a $C_2$-$C_{13}$ straight- or branched-chain aliphatic alcohol.

* * * * *